United States Patent [19]

Margrave et al.

[11] Patent Number: 4,906,203

[45] Date of Patent: Mar. 6, 1990

[54] ELECTRICAL CONNECTOR WITH SHORTING CLIP

[75] Inventors: Christopher A. Margrave, Cortland; Randall K. Smith, Fowler; Charles E. Fowler, Boardman; Glenn E. Robison, Cortland, all of Ohio

[73] Assignee: General Motors Corporation, Detroit, Mich.

[21] Appl. No.: 261,667

[22] Filed: Oct. 24, 1988

[51] Int. Cl.[4] ..... H01R 29/00

[52] U.S. Cl. ..... 439/188; 439/510

[58] Field of Search ..... 439/188, 93, 513, 510

[56] References Cited

U.S. PATENT DOCUMENTS

| | | | |
|---|---|---|---|
| 1,825,208 | 9/1931 | Rumble | 200/51.1 |
| 3,133,777 | 5/1964 | Anhalt | 339/91 |
| 3,869,191 | 3/1975 | Tolnar, Jr. et al. | 339/111 |
| 4,070,557 | 1/1978 | Ostapovitch | 339/19 |
| 4,148,538 | 4/1979 | Rodondi | 339/91 |
| 4,152,041 | 5/1979 | Hollyday et al. | 439/188 |
| 4,170,939 | 10/1979 | Hoheisel et al. | 339/19 |
| 4,433,888 | 2/1984 | Winger | 339/91 |
| 4,470,651 | 9/1984 | Schwab | 439/510 |
| 4,602,839 | 7/1986 | Winger | 339/91 |
| 4,634,204 | 1/1987 | Detter et al. | 339/91 |
| 4,786,258 | 11/1988 | Shaffer et al. | 439/188 |
| 4,795,602 | 1/1989 | Pretchel et al. | 439/510 |

OTHER PUBLICATIONS

AMP Deutschland Drawings 827 099 and 926 721.

Packard Electric Division Drawings 1201 5082; 1206 6330; 1206 6331; 1206 6332.

Packard Electric Division Drawings 1206 6336; 1206 6337; 1206 6362.

*Primary Examiner*—P. Austin Bradley

*Attorney, Agent, or Firm*—F. J. Fodale

[57] ABSTRACT

An electrical connector comprises a plug connector body which has a pair of female terminals and a U-shaped, sheet metal shorting clip. The shorting clip is retained in an intermediate cavity and has a pair of cantilevered spring contact arms which engage respective side walls of the female terminals. A mating electrical connector comprises a socket connector body which has a cam which engages one of the spring contact arms of the shorting clip and disengages the shorting clip form the side wall of one female terminal when the socket connector body is connected to the plug connector body. A loose piece shroud which is attached to the plug connector body has a lock arm which engages a lock member of the socket connector body to lock the mated plug and socket connector bodies together.

9 Claims, 2 Drawing Sheets

ELECTRICAL CONNECTOR WITH SHORTING CLIP

BACKGROUND OF THE INVENTION

This invention relates generally to electrical connectors and more specifically to electrical connectors which are equipped with a shorting clip which automatically shunts terminals in the electrical connector when it is disconnected from a mating electrical connector.

Packard Electric Division of General Motors Corporation produces a two way electrical female connector which has a shorting clip which is housed in a plug connector body. The shorting clip is a bent wire which has a generally U-shaped body which is mounted in a slot above a pair of laterally spaced terminal cavities. The bent wire shorting clip includes two depending legs at the respective ends of the U-shaped body. These depending legs engage the sides of the respective female terminals which are disposed in terminal cavities of the plug connector body.

The mating electrical male connector has a socket connector body which includes a converging slot at its mating end. The depending legs of the wire shorting clip are squeezed together and disengaged from the sides of the female terminals by the converging slot when the female connector is plugged into the male connector. The plug connector body of the female connector is also equipped with an external lock arm which secures the female connector to the mating male connector.

While the present electrical connector is suitable for many applications, there are other applications where the present electrical connector is too large. For example, an air restraint system which has an inflatable air bag in a steering wheel requires a wiring harness which is capable of being threaded through the steering column. An electrical connector for the end of such a wiring harness has stringent size requirements in order for the electrical connector to pass through the tight spaces inside the steering column. Such stringent size requirements cannot be met by known prior art electrical connectors with shorting clips such as that discussed above. Consequently, electrical connectors are presently attached after the wiring harness has been threaded through the steering column which is a costly and inefficient assembly operation.

SUMMARY OF THE INVENTION

The object of this invention is to provide an electrical connector of the above noted type which is reduced in size that the electrical connector can be attached to the end or a wiring harness and passed through tight spaces such as those in the interior of a steering column.

This is generally accomplished by reducing the cross sectional height of the connector body while maintaining the width of the connector body and the lateral spacing of the terminals so that the mating electrical connector does not need alteration.

A feature of the invention is that the cross sectional height of the shorting clip does not exceed the height of the terminals so that the cross sectional height of the connector body is minimized.

Another feature of the invention is that a shorting clip of one piece construction is disposed between a pair of terminals to simplify construction while reducing the cross section of the connector.

Another feature of the invention is that the shorting clip is fabricated from flat strip stock to provide large contact areas for engaging the terminals which are being shunted.

Yet another feature of the invention is that the spring contact arms of the shorting clip are configured to reduce the lateral space requirements for the shorting clip.

Still yet another feature of the invention is that the shorting clip is secured in the connector body independently of the terminals so that the terminals may be easily assembled into the connector body after the terminals have been attached to the cable ends.

Still yet another feature of the invention is that the electrical connector may be provided with a lock arm by fitting a loose piece shroud onto the connector body after the electrical connector has been passed through the tight spaces which require an electrical connector of reduced size.

Other objects and features of the invention will become apparent to those skilled in the art as disclosure is made in the following detailed description of a preferred embodiment of the invention which sets forth the best mode of the invention contemplated by the inventors and which is illustrated in the accompanying sheet(s) of drawing.

DETAILED DESCRIPTION OF THE PREFERRED EMBODIMENT

Figure 1:
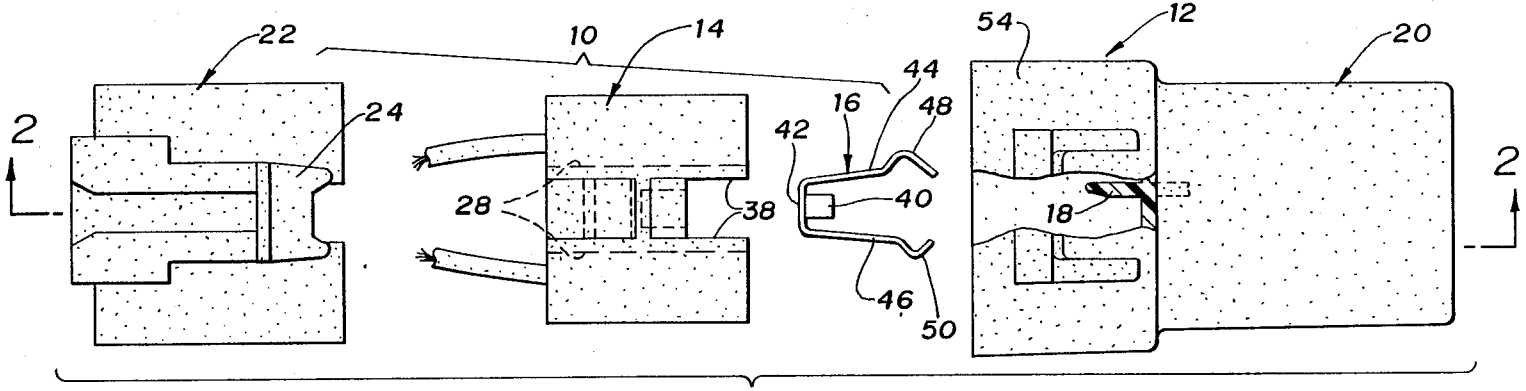
FIG. 1 is an exploded, partially sectioned top view of matable electrical connectors comprising the invention.
Figure 2:
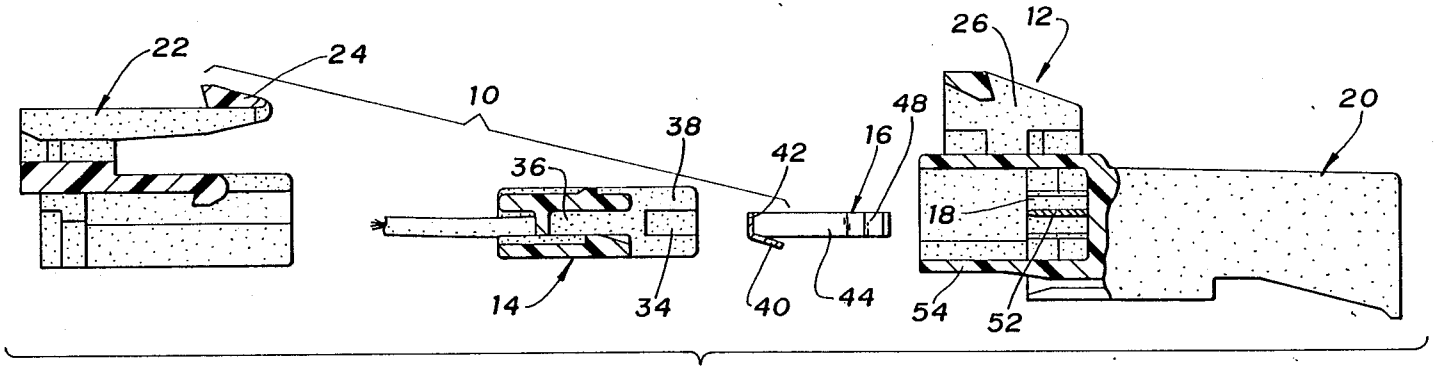
FIG. 2 is a longitudinal section of the exploded electrical connectors taken substantially along the line 2—2 of FIG. 1 looking in the direction of the arrows.

Referring now to the drawing and more particularly to FIGS. 1 and 2, matable electrical female and male connectors 10 and 12 comprising the invention are shown in exploded top and longitudinal section views respectively.

The electrical female connector 10 comprises a plug connector body 14 which houses a shorting clip 16 which is disengaged by a cam 18 of the socket connector body 20 which forms part of the male connector 12. The electrical female connector 10 also includes a loose piece shroud 22 which has a lock arm 24 which cooperates with a lock piece 26 of the male connector 12 for locking the mated connectors together.

The plug connector body 14 of the electrical female connector 10 has a pair of laterally spaced terminal cavities 28 which house a pair of sheet metal female terminals 30. These female terminals have box-like receptacles 32 at the mating end which include side walls 34.

The plug connector body 14 also has an intermediate cavity 36 which is disposed between the laterally spaced terminal cavities 28 and which communicates with the terminal cavities 28 via slots which extend through the internal walls 38 of the terminal cavities 28 to expose the internal side walls 34 of the female terminals 30.

The shorting clip 16 is formed from a flat strip of sheet metal into a generally U-shaped configuration as best shown in FIG. 1. The shorting clip 16 is housed in the intermediate cavity 36 and retained by a latch finger 40 which is integrally attached to the base 42 of the U-shaped shorting clip. The clip 16 has a pair of diverging spring contact arms 44 and 46 which are attached to the base 42 in cantilever fashion.

The spring contact arms 44, 46 have free end portions 48, 50 which are transversely ribbed to provide converging tips followed by smooth convexly curved outer contact surfaces which engage the exposed side walls 34 of the female terminals 30 when the terminals are inserted into the terminal cavities 28.

The shunt produced by the shorting clip 16 is opened or broken by disengaging only one of the spring contact arms which reduces lateral space requirements for the shorting clip 16. Specifically, the spring contact arm 44 is cammed away from the side wall 34 of the female terminal 30 by the cam 18 of the socket connector body 20 when it is mated to the plug connector body 14. The transversely ribbed free end portion 48 of the cammed contact arm 44 is enlarged to facilitate engagement by the cam 18 while the free end portion 50 of the uncammed or stationary contact arm 46 is reduced in size to increase the space available for camming the contact arm 44 away from the exposed side wall of the terminal which it engages. This special configuration of the free end portions 46, 48 further reduces lateral space requirements for the shorting clip 16.

The socket connector body 20 of the male connector 12 which mates with the plug connector body 14 has a pair of laterally spaced terminal cavities which house a pair of sheet metal male terminals 52 which have tabs which project into the socket portion 54 of the socket connector body 14 so as to mate with the pair of female terminals 30 when the plug connector body 14 is plugged into the socket connector body 20. The cam 18 forms part of a vertical interior wall which lies in the socket portion 54 between the projecting tabs of the male terminals 52.

Figure 3:
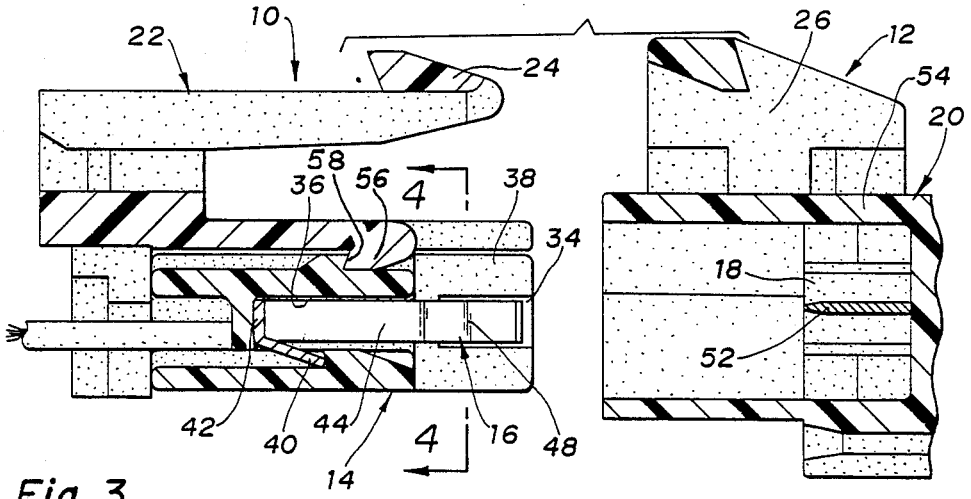
FIG. 3 is a enlarged, longitudinal section of the matable electrical connectors which are shown in FIG. 1.
Figure 4:
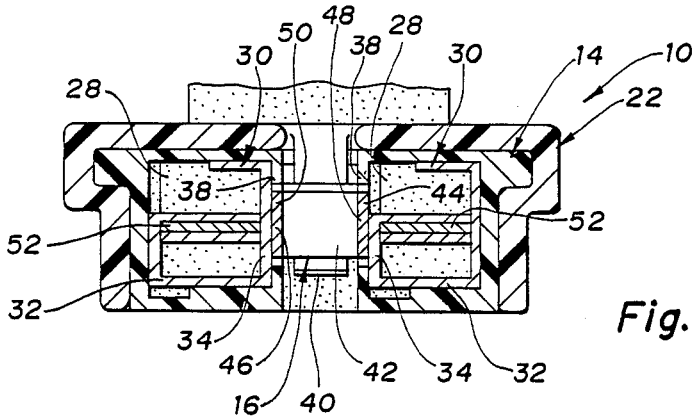
FIG. 4 is a section taken substantially along the line 4—4 of FIG. 3 looking in the direction of the arrows.
Figure 5:
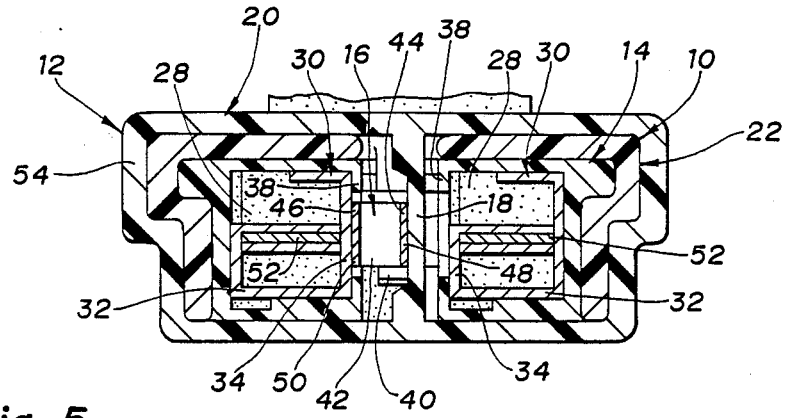
FIG. 5 is a view similar to FIG. 4 showing the connectors of FIG. 3 mated.

The electrical connector 10 may be secured to the electrical connector 12 by a loose piece shroud 22 which is attached to the plug connector body 14 after the electrical connector 10 has been passed through the tight spaces which require its small size. The loose piece shroud 22, which is channel shaped as shown in FIG. 5, slideably receives the plug connector body 14 which is then retained by a latch arm 56 against a rearward shoulder 58 of the shroud 22 as shown in FIG. 3. As indicated above the loose piece shroud 22 includes a lock arm 24 which cooperates with the lock piece 26 of the socket connector body 20 to lock the electrical connectors 10 and 12 together. The lock arrangement may be of the type which includes a connector position assurance device (not shown) such as that which is disclosed in Gary Detter et al U.S. Pat. No. 4,634,204 granted Jan. 6, 1987.

We wish it to be understood that we do not desire to be limited to the exact details of construction shown and described, for obvious modifications will occur to a person skilled in the art.

The embodiments of the invention in which an exclusive property or privilege is claimed are defined as follows:

1. An electrical connector comprising:

a first connector body which has a pair of laterally spaced terminal cavities, a first pair of metal terminals which are housed in the respective first terminal cavities and which have side walls, the first connector body having an intermediate cavity which is disposed between the first terminal cavities and which communicates with the first terminal cavities to expose the side walls of the metal terminals which are housed in the first terminal cavities, and a U-shaped, sheet metal shorting clip of one piece construction which is retained in the intermediate cavity independently of the first pair of terminals and which has a pair of cantilevered spring contact arms which have free end portions which engage the respective exposed side walls of the first pair of metal terminals, the free end portion of one of the spring contact arms of the shorting clip having a tip which converges toward the other spring contact arm to facilitate camming the one spring contact arm away from the side wall of the terminal which it engages.

2. An electrical connector comprising:

a first connector body which has a pair of laterally spaced terminal cavities, a first pair of metal terminals which are housed in the respective first terminal cavities and which have side walls, the first connector body having an intermediate cavity which is disposed between the first terminal cavities and which communicates with the first terminal cavities to expose the side walls of the metal terminals which are housed in the first terminal cavities, and a U-shaped, sheet meal shorting clip of one piece construction which is retained in the intermediate cavity independently of the first pair of terminals and which has a pair of cantilevered spring contact arms which have free end portions which engage the respective exposed side walls of the first pair of metal terminals, the free end portions of the spring contact arms of the shorting clip being transversely ribbed to provide converging tips which are followed by smooth convexly curved outer contacts for engaging the terminals when the terminals are inserted into the terminal cavities.

3. The electrical connector as defined in claim 2 wherein the free end portion of one contact arm is enlarged while the free end portion of the other contact arm is reduced to increase the space available for the one contact arm to move toward the other contact arm.

4. An electrical connector comprising:

a first connector body which has a pair of laterally spaced terminal cavities, a first pair of metal terminals which are housed in the respective first terminal cavities and which have side walls, the first connector body having an intermediate cavity which is disposed between the first terminal cavities and which communicates with the first terminal cavities to expose the side walls of the metal terminals which are housed in the first terminal cavities, a U-shaped, sheet metal shorting clip of one piece construction which is retained in the intermediate cavity independently of the first pair of terminals and which has a pair of cantilevered spring contact arms which have free end portions which engage the respective exposed side walls of the first pair of metal terminals, and a shroud which is attached to the first connector body and which has a lock arm for locking the first connector body to a mating connector body.

5. An electrical connector comprising:

a plug connector body which has a pair of laterally spaced terminal cavities, a pair of sheet metal female terminals which are housed in the respective first terminal cavities and which have side walls, the plug connector body having an intermediate cavity which is disposed between the first terminal cavities and which communicates with the first terminal cavities through slots in internal walls of the terminal cavities which expose the side walls of the female terminals which are disposed in the first terminal cavities, a U-shaped, sheet metal shorting clip which is housed in the intermediate cavity and which has a pair of cantilevered spring contact arms which have free end portions which engage the respective exposed side walls of the female terminals, a socket connector body which is matable with the plug connector body and which houses a pair of sheet metal male terminals which are adapted to mate with the pair of female terminals in the plug connector body, the socket connector body having a cam at its mating end which engages a tip at the free end of one of the spring contact arms of the shorting clip and disengages the shorting clip from the exposed side wall of one of the female terminals in the plug connector body when the socket connector body is connected to the plug connector body and the pairs of male and female terminals matingly engage each other.

6. The electrical connector as defined in claim 5 wherein the tip at the free end portion of the spring contact arm which is engaged by the cam converges toward the other spring contact arm to facilitate camming the spring contact arm away from the side wall of the terminal which it engages and wherein the cam forms part of a vertical interior wall which lies in the socket portion of the socket connector body between the male terminals.

7. The electrical connector as defined in claim 5 further including a loose piece shroud which is attached to the plug connector body and which has a lock arm which engages a lock member of the socket connector body to lock the plug and socket connector bodies together.

8. The electrical connector as defined in claim 5 wherein the free end portions of the spring contact arms of the shorting clip are transversely ribbed to provide converging tips followed by smooth convexly curved outer contacts for engaging the female terminal when the female terminals are inserted into the terminal cavities of the plug connector body.

9. The electrical connector as defined in claim 8 wherein the free end portion of the contact arm which is engaged by the cam is enlarged while the free end portion of the other contact arm is reduced to increase the space available for the one contact arm to move toward the other contact arm.

* * * * *